United States Patent [19]

Humble

[11] 3,933,240

[45] Jan. 20, 1976

[54] ANTI-THEFT SECURITY CONTAINER

[75] Inventor: David R. Humble, Lauderhill, Fla.

[73] Assignee: Sensormatic Electronics Corporation, Hollywood, Fla.

[22] Filed: Oct. 15, 1974

[21] Appl. No.: 514,490

[52] U.S. Cl. ..... 206/1.5; 70/63; 214/300; 221/297; 340/280

[51] Int. Cl.[2] ..... B65D 55/04; B65B 69/00

[58] Field of Search ..... 206/1.5; 70/63; 340/280; 221/297, 310; 214/300

[56] References Cited

UNITED STATES PATENTS

| | | | |
|---|---|---|---|
| 845,815 | 3/1907 | Pfleger | 70/63 |
| 3,818,472 | 6/1974 | Mauk et al. | 340/280 |
| 3,828,922 | 8/1974 | Holkestad | 206/1.5 |

*Primary Examiner*—Leonard Summer
*Attorney, Agent, or Firm*—Buckles and Bramblett

[57] ABSTRACT

A transparent security container for an article to be displayed, such as a tape cassette. The container includes an anti-theft device such as a microwave reradiator which triggers an alarm if it enters a microwave field. The container includes a pair of spaced key slots associated with clips for retaining the cassette. A release device at the checkout station permits easy release of the cassette. The container may then be reused.

16 Claims, 10 Drawing Figures

ANTI-THEFT SECURITY CONTAINER

BACKGROUND OF THE INVENTION

A well known and effective system for preventing shoplifting comprises a pair of scanners for setting up a microwave field at, for example, an exit of a store. Attached to merchandise to be protected are special tags which carry reradiating circuitry. When an item is properly purchased, the clerk removes the tag at the point of sale. If the tag is not removed and someone attempts to shoplift the tagged item, the reradiator energizes an alarm when it enters the microwave field, thereby alerting store personnel.

The foregoing system has proved to be extremely successful in combating shoplifting. However, certain types of merchandise cannot readily be tagged in such a manner. Tape cassettes, for example, are particularly attractive to shoplifters and are difficult to tag. Furthermore, most stores would prefer to display tape cassettes openly as an encouragement to impulse buying. Many other items present similar problems, such as, for example, small cameras, wrist watches, writing implements, lighters, etc.

Accordingly, it is a primary object of the present invention to provide improved protection for items difficult to tag with reradiating devices. Other objects are to provide such protection while keeping the protected item in open view, and rendering the reradiating device difficult of removal by a shoplifter but easily removable by a checkout clerk. The manner in which these objectives are achieved will be apparent from the following description and appended claims.

SUMMARY OF THE INVENTION

Apparatus for preventing the unauthorized removal of an article of merchandise from a protected area comprising a container which has a main opening for receiving the article and at least two spaced key openings. The container carries an electromagnetic reradiator and includes article retaining means having a first position clear of the main opening and a second position blocking the opening. An article release device at the point of sale includes at least two spaced keys which are simultaneously advanceable into the key openings for shifting the retaining means from the second position to the first position.

DESCRIPTION OF THE PREFERRED EMBODIMENT

Figure 3:
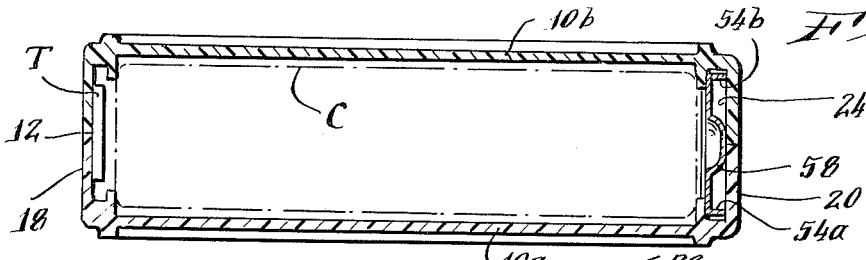
FIG. 3 is a cross section taken substantially along the line 3—3 of FIG. 1.
Figure 1:
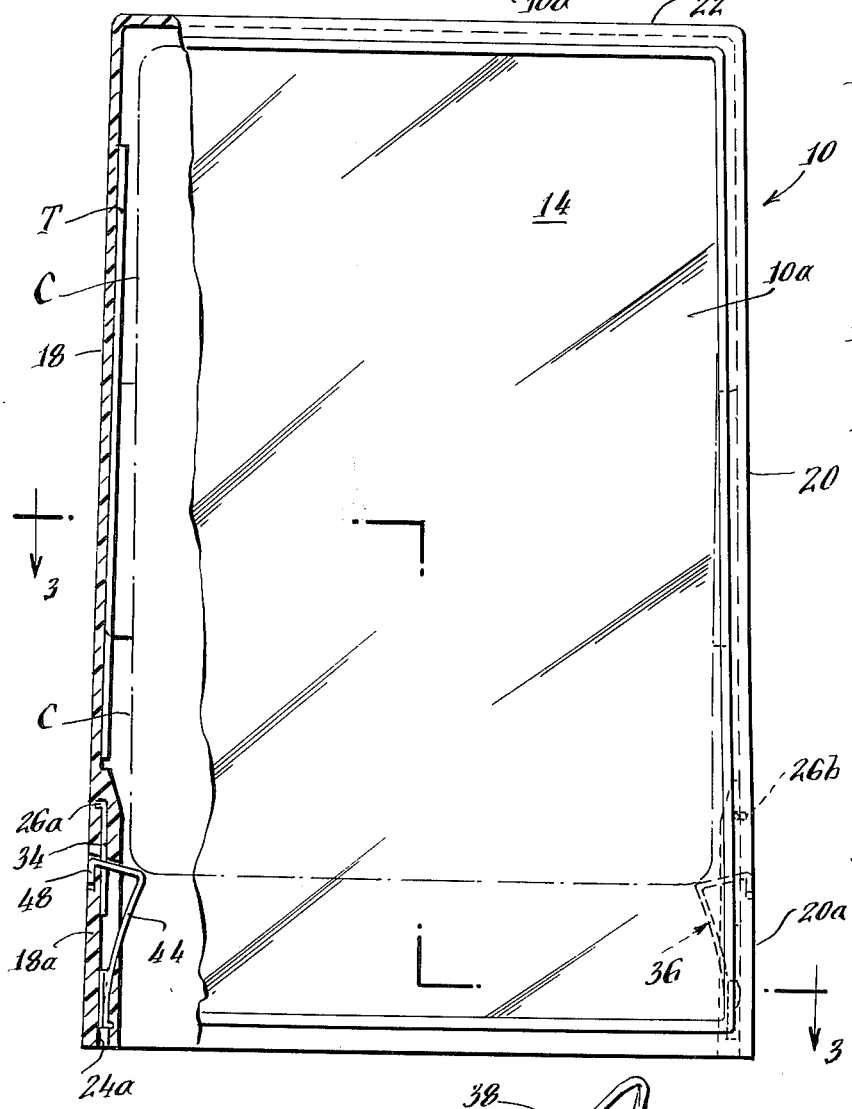
FIG. 1 is a front view of an article container in accordance with this invention, partially broken away to illustrate its internal construction.
Figure 2:
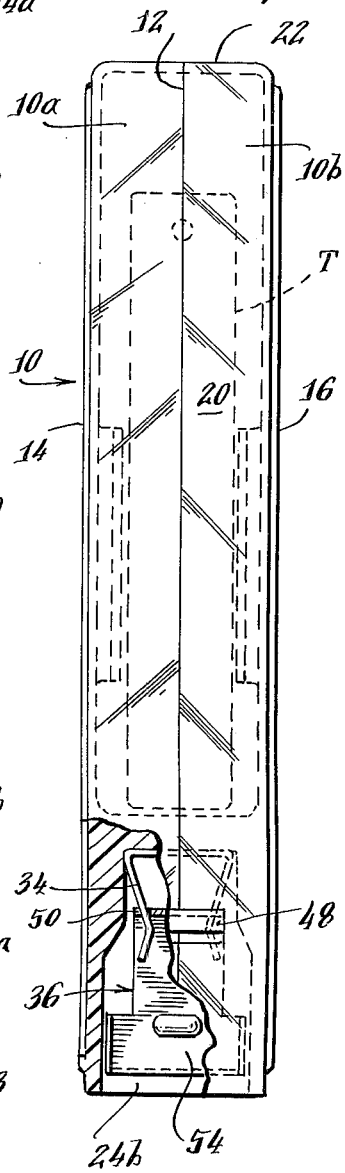
FIG. 2 is a side view of the container of FIG. 1, also partially broken away.

This invention will be described with particular reference to a display container for a typical 8 track stereo tape cassette. There is illustrated in FIGS. 1–3 a transparent plastic container 10 formed from two identical halves 10*a*, 10*b* ultrasonically welded along a seam 12. The container 10 includes front wall 14 and back wall 16, left 18 and right 20 sidewalls and top wall 22. The container is open at the bottom. Cemented or otherwise secured within the container and against sidewall 18 is a reradiating tag T. The dimensions of the container 10 are such as to easily receive a standard cassette C. At the bottom of each of sidewalls 18, 20 is a thickened portion 18*a*, 20*a*. The article retaining and releasing mechanisms are located in the thickened portions. The mechanisms in the two sidewalls are substantially identical and, accordingly, will be given similar reference numerals but with an *a* appended for parts in the left sidewall and a *b* appended for parts in the right sidewall.

The thickened portions of the sidewalls define vertical key slots 24*a*, *b*. As will be most apparent from FIG. 2, the slots 24 are widest at the bottom and are narrower at their upper ends. Other features of the slot construction can best be seen in the enlarged cross section of FIG. 9 where it will be noted that the bottom of the slot 24*b* is slightly flared to permit easier entry of a key as will be later explained. It will also be noted that the top of the slot includes a small recess 26 running along its width. Still referring to FIG. 9, it will be noted that the thickened portion of the sidewall is pierced by a transverse opening 28 having a lip 30 positioned inwardly of the external surface of the sidewall. A second horizontal recess 32 is formed along the inner surface of the slot 24.

Figure 4:
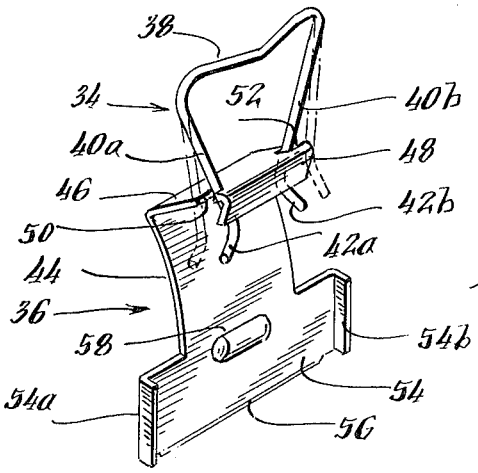
FIG. 4 is a perspective view illustrating the construction and operation of the article retaining clip and latching spring employed in the invention.

Mounted in each of the key slots 24 are the spring 34 and clip 36 illustrated in FIG. 4. Spring 34 includes a substantially horizontal bight portion 38 having a slight bow therein as viewed from the top. The bight portion, aided by the bow is retained within the recess 26 at the upper end of each of the slots 24. The spring 34 also includes depending legs 40*a*, 40*b* which are bent inwardly toward each other along most of their lengths but near their lower ends are curved out to provide camming portions 42*a*, 42*b*.

The clip 36 is formed from spring steel. It comprises a vertical back plate 44 which is normally substantially planar and is bent at its upper end to form an outwardly extending shelf portion 46 terminating in a downwardly extending flange 48. At each end of shelf 46 is a notch 50, 52. The lower end of clip 36 includes a horizontal member 54 having a length substantially equal to the width of the key slot 24 and forwardly extending projections 54*a*, 54*b* which extend forwardly a distance approximately equal to the thickness of the slot. Across the lower edge of horizontal member 54 is a rearwardly extending flange 56. Approximately centrally located on the horizontal member 54 is a projection 58 which has a height approximately equal to the thickness of the slot 24.

Figure 9:
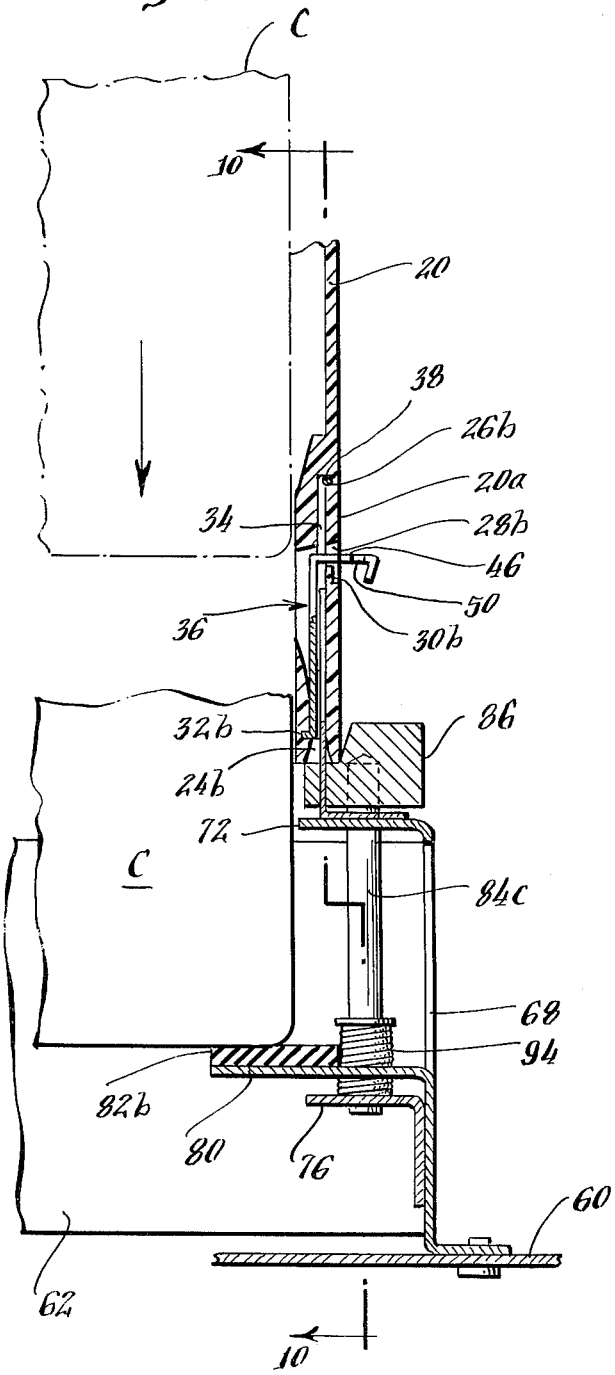
FIG. 9 is an enlarged cross section illustrating the operation of the release mechanism.

As will be apparent from FIG. 9, the clip 36 is positioned in slot 24 with its flange 56 retained in recess 32.

When the clip is in its unstressed position, as shown in FIG. 9, the shelf 46 extends outwardly through the transverse opening 28, the legs 40*a*, 40*b* of the spring 34 being forced outwardly and resting against the ends of the shelf portion 46 of the clip.

Figure 7:
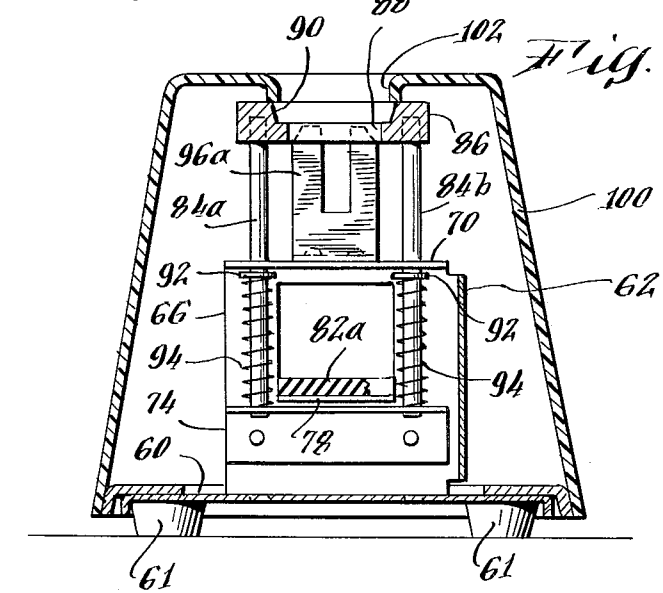
FIG. 7 is a cross section taken substantially along the line 7—7 of FIG. 6.
Figure 5:
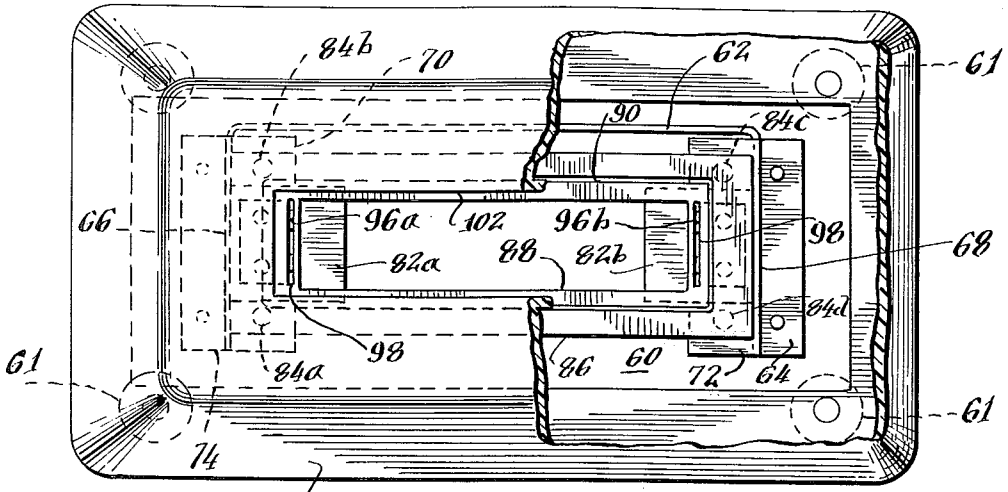
FIG. 5 is a top view, partially broken away, of the article release device used at the point of sale.
Figure 6:
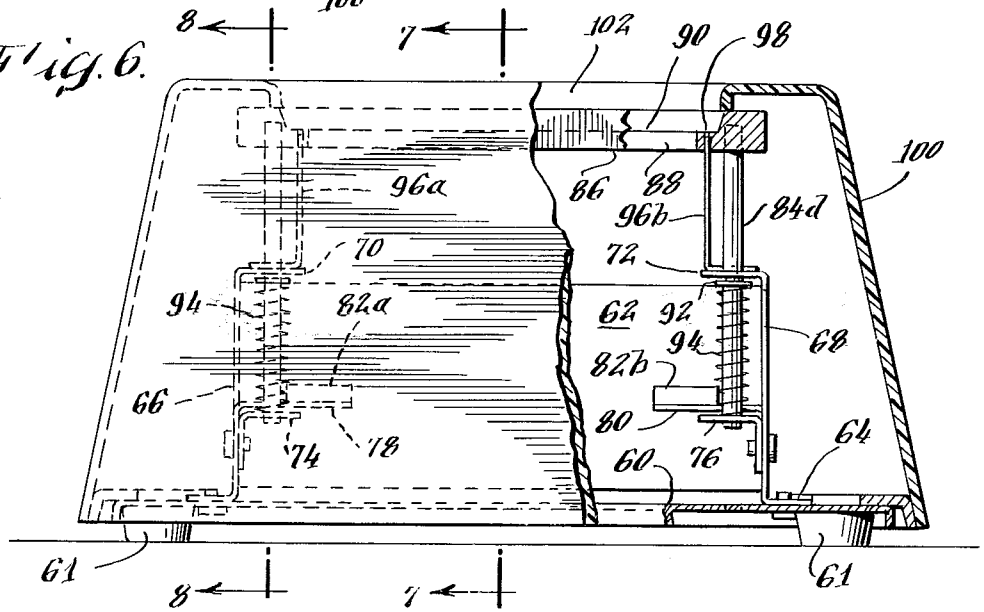
FIG. 6 is a front elevation, partially broken away, of the device of FIG. 5.

The construction of the release device provided at the checkout counter is illustrated in FIGS. 5–7. It comprises a support base 60 resting on feet 61. A three sided boxlike chassis 62 is mounted on base 60 by means of bolts through end flanges 64. The left 66 and right 68 chassis ends are bent over at their tops to form corresponding left 70 and right 72 support shelves. Mounted upon each of the chassis ends and below the corresponding support shelves are left 74 and right 76 angle iron brackets. Each of the chassis ends is formed with an inverted U-shaped cut and the material within the cut is bent inwardly to provide bumper brackets 78, 80 which support resilient bumper pads 82*a*, 82*b* thereon.

Figure 8:
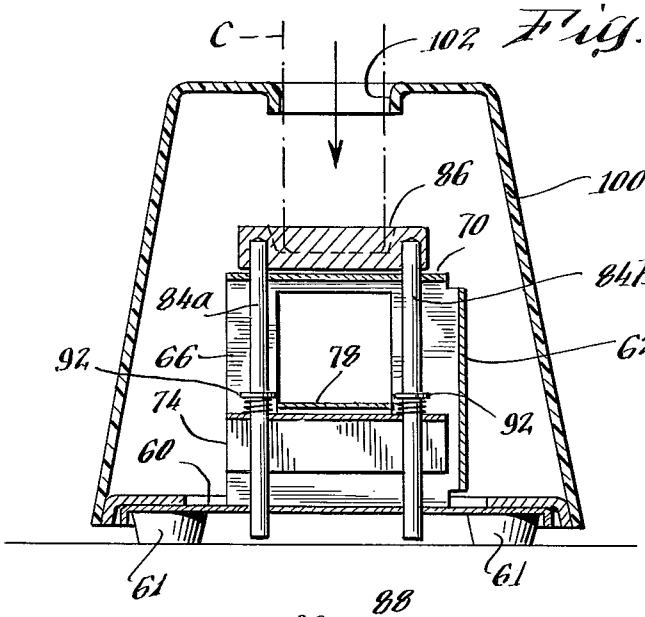
FIG. 8 is a cross section taken substantially along the line 8—8 of FIG. 6.

The support shelf 70, angle iron bracket 74, and base 60 at the left end of the device are drilled to receive actuating rods 84*a*, 84*b* therein. The right end members are similarly drilled to receive actuating rods 84*c*, 84*d*. The tops of the four actuating rods 84 are secured to an actuating plate 86 which defines an elongated opening 88 therethrough surrounded by a shallow recess 90 in its upper surface. Each of the rods 84 carries a retainer 92 and surrounding each rod between its retainer and lower bracket 74 or 76 is a compression spring 94. It will now be seen that the rods and actuating plate are normally maintained in a raised position by the springs 94 as shown in FIG. 7 but may be depressed to the position illustrated in FIG. 8 by downward force. Mounted on the support shelves 70, 72 are a left 96*a* and right 96*b* key, each being bifurcated as shown in FIG. 7 and having its upper, outer corners cut away to form sloping shoulders. Each of the keys 96 extends through a corresponding slot 98 in the actuating plate 86. The entire assembly is enclosed by molded outer housing 100 having an upper opening 102 surrounding the opening in actuating plate 86.

OPERATION

Figure 10:
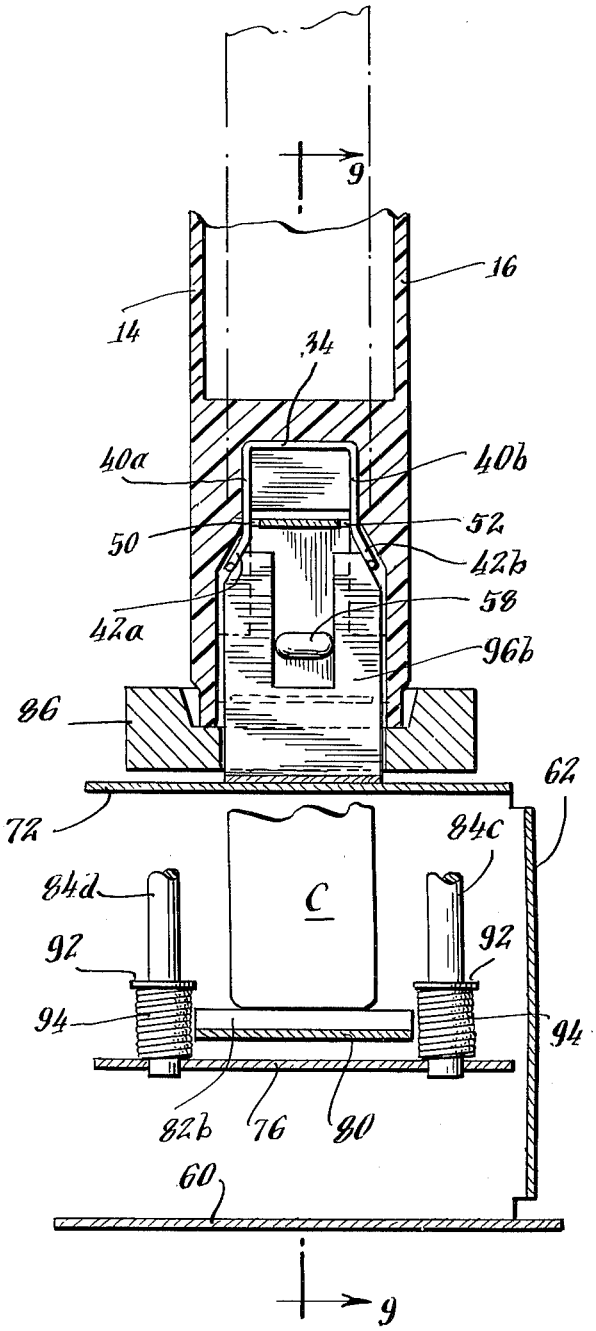
FIG. 10 is a cross section taken substantially along the line 10—10 of FIG. 9.

The operation of this invention will now be explained with particular reference to FIGS. 9 and 10. Assume first that the container is unloaded. When empty, the clips 36 are in the positions illustrated in FIGS. 9 and 10 with the backplate 44 substantially flat. The shelf portions 46 extend outwardly through the sides of the container holding the legs 40*a*, 40*b* of the spring 34 in the spread positions shown in FIG. 10. In this configuration, the opening of the container is clear and a cassette is inserted therein. Thereafter, the clips 36 are manually depressed. The backplate 44 bows and the clips assume the position illustrated in FIGS. 1 and 4, whereupon the legs 40*a*, 40*b* of each spring snap into the notches 50, 52 to retain the clip in such position. The clips thereby block the opening and prevent the cassette from being removed from the container.

It is recommended that the container be made of a transparent material, but that those portions enclosing the spring clip mechanisms be opaque. In this manner a potential shoplifter will be unable to determine how the mechanism works. It should be noted that the clips cannot be pried outwardly due to the presence of the spring 34 and that a solid object cannot be inserted into the slot due to the blocking function of the projection 58.

Upon arrival at the checkout counter, the clerk merely inserts the blocked open end of the container into the opening 102 of the housing and presses down. The keys 96 enter the respective keyways and, since they are bifurcated, straddle the projection 58 as shown in FIG. 10. The sloping shoulders of each key contact the camming portions 42*a*, 42*b* of the springs, spreading the legs which move out of notches 50, 52. This unlatches the clips and permits them to snap back into the position illustrated in FIG. 9. Upon thus unblocking the opening, the cassette C falls into the housing and comes to rest on the bumper pads 82*a*, 82*b*. The container is retained for further use and the cassette is removed from the housing and given to the purchaser.

It is believed that the many advantages of this invention will now be apparent to those skilled in the art. It will also be apparent that a number of variations and modifications may be made in this invention without departing from its spirit and scope. Accordingly, the foregoing description is to be construed as illustrative only, rather than limiting. This invention is limited only by the scope of the following claims.

I claim:

1. Apparatus for preventing unauthorized removal of an article of merchandise from a protected area which comprises: a container defining a main opening therein for receiving said article and at least two spaced key openings adjacent said main opening: an electromagnetic reradiator carried by said container; first and second resilient clips carried by said container, each having a normal first position clear of said main opening but bendable to a second position blocking said main opening; means for latching said clips in said second position; and an article release member including at least two spaced key means simultaneously advanceable into said key openings for shifting each of said clips from said second position to said first position.

2. The apparatus of claim 1 wherein said key means are positioned to release said latching means from said clips upon advancement into said key openings.

3. The apparatus of claim 2 wherein said latching means comprises first and second spring means cooperating, respectively, with shoulders on said first and second clips.

4. The apparatus of claim 3 wherein each of said spring means comprises spaced legs normally angled toward each other and positioned to receive one of said key means therebetween, said key means being shaped to bias said legs apart to release said clip.

5. The apparatus of claim 1 wherein said release member comprises: a base; first and second key means supported by said base in spaced apart relationship; a housing substantially enclosing said base and key means and defining a top opening overlying said key means; actuating plate means within said housing normally positioned against said top opening but downwardly movable upon the application of force, said actuating plate means defining first and second passages positioned to receive said key means therethrough and an article opening positioned to receive therethrough an article released from said container.

6. The apparatus of claim 5 wherein said article retaining means comprises: first and second resilient clips normally in said first position but bendable to said second position; and means for latching said clips in said second position.

7. The apparatus of claim 6 wherein said key means are positioned to release said latching means from said clips upon advancement into said key openings.

8. The apparatus of claim 7 wherein said latching means comprises first and second spring means cooperating, respectively, with shoulders on said first and second clips.

9. The apparatus of claim 8 wherein each of said spring means comprises spaced legs normally angled toward each other and positioned to receive one of said key means therebetween, said key means being shaped to bias said legs apart to release said clip.

10. A container for holding an article of merchandise which comprises: a hollow body defining a main opening therein for receiving said article and at least two spaced key openings adjacent said main opening; an electromagnetic reradiator carried by said body; first and second resilient clips carried by said body, each having a normal first position clear of said main opening but bendable to a second position blocking said main opening; and means for latching said clips in said second position.

11. The container of claim 10 wherein said latching means comprises first and second spring means cooperating, respectively, with shoulders on said first and second clips.

12. The container of claim 10 wherein said hollow body is substantially rectangular in cross section, said main opening is defined by the side walls at one end thereof, and said key openings are slots defined by two opposed sidewalls.

13. The container of claim 12 wherein each of said opposed sidewalls defines transverse openings therethrough communicating with its key slot.

14. The container of claim 13 wherein each of said article retaining means comprises a clip having a bendable vertical back plate normally retained by its key slot and a shelf portion laterally movable through the associated transverse opening between said first and second positions.

15. The container of claim 14 wherein each of said article retaining means comprises means for releasably latching said clips in said second position.

16. A release mechanism for an article holding container which comprises: a base; first and second key means supported by said base in spaced apart relationship; a housing substantially enclosing said base and key means and defining a top opening overlying said key means; actuating plate means within said housing normally positioned against said top opening but downwardly movable upon the application of force, said actuating plate means defining first and second passages to receive said key means therethrough and an article opening positioned to receive therethrough an article released from said container.

* * * * *